US005944633A

United States Patent [19]

Wittrock

[11] Patent Number: 5,944,633

[45] Date of Patent: Aug. 31, 1999

[54] HAND-HELD WORKOUT TRACKER

[76] Inventor: Paul N. Wittrock, 2118 37th St., NW., Washington, D.C. 20007

[21] Appl. No.: 08/787,712

[22] Filed: Jan. 24, 1997

[51] Int. Cl.[6] ..... A63B 21/00

[52] U.S. Cl. ..... 482/4; 482/5; 482/92; 482/902

[58] Field of Search ..... 482/1–9, 51, 92–104, 482/110–112, 900–902

[56] References Cited

U.S. PATENT DOCUMENTS 4,220,992 9/1980 Blood et al. .
4,283,712 8/1981 Goody .
4,408,183 10/1983 Wills .
4,828,257 5/1989 Dyer et al. ..... 482/9
4,879,651 11/1989 Little, Jr. .
4,911,427 3/1990 Matsumoto et al. .
5,387,164 2/1995 Brown, Jr. .
5,410,472 4/1995 Anderson .
5,476,427 12/1995 Fujima .
5,478,295 12/1995 Fracchia .
5,516,334 5/1996 Easton .

*Primary Examiner*—Glenn E. Richman
*Attorney, Agent, or Firm*—Evenson, McKeown, Edwards & Lenahan, P.L.L.C.

[57] ABSTRACT

An apparatus and a method for recording, displaying, and analyzing data regarding a weightlifting workout, specifically, weight, repetitions, and sets performed for each of various exercises. The apparatus includes a data memory and a means for inputting a plurality of data sets into the data memory. The method includes the step of inputting a plurality of data sets into a data memory. Each of the data sets comprises a weight and a number of repetitions.

27 Claims, 10 Drawing Sheets

HAND-HELD WORKOUT TRACKER

BACKGROUND AND SUMMARY OF THE INVENTION

The present invention is directed to a method and an apparatus for tracking a workout, and more particularly to a method and an apparatus for recording and displaying data regarding a weightlifting workout.

Bodybuilders, athletes, conditioning coaches, personal trainers, physical therapists as well as individuals engaged in weight training simply for fitness and conditioning all share a common need; a way of recording and monitoring their workouts. In the past, this has been done manually, e.g. by hand-writing data regarding a workout on a recording paper such as a notebook or a chart supplied by a gym or a fitness specialty company. This known method of tracking a workout is cumbersome and inefficient since both a piece of paper and a writing instrument must be carried around to various workout stations. Furthermore, the recording paper may easily be damaged. For example, when a weightlifter becomes sweaty during the workout, sweat may drip onto the recording paper, or be transferred to the paper as it is carried around making the recorded data smear or run and making it difficult to write thereon. In addition, a person who is keeping track of their workout on a piece of paper must improvise in order to put the data into an organized format. As a result, often the workout data is recorded in varying formats, for example on different workout days, which makes it more difficult to analyze and compare the data, as well as to correlate progress to other factors such as diet, etc. As can be seen, the previously known method for tracking a workout has many disadvantages.

The prior art shows various apparatus and methods for recording information regarding certain recreational sports and redundant physical activities. For example, Little, Jr. (U.S. Pat. No. 4,879,651) shows a calculator to be worn on the wrist of a racquetball, tennis, handball, squash, or golf player, which categorizes and lists points won by the user and the type of shot on which the win was based, and also categorizes and lists points lost to an opponent and the type of shots on which the loss was based. Blood et al. (U.S. Pat. No. 4,220,992) shows a portable battery-powered golf analyzing device including a keyboard useable in an input mode to insert data describing each golf shot made by a player. In an output mode, the memory can be queried to determine the number and percentages of a certain type of golf shot. Blood et al. describes the device as being adaptable for bowling and football. Both Little, Jr. and Blood et al. are directed to ways of recording specific information regarding a type of shot made by a game player. Goody (U.S. Pat. No. 4,283,712) shows a portable exercise totalizer for recording total exercise exertion during various exercise routines such as walking, jogging, running, sprinting, and the like. None of the prior art discloses or suggests a method or an apparatus having any applicability to the aforementioned problems encountered in attempting to track a weightlifting workout.

There is therefore needed an advantageous method and apparatus for accurately and consistently tracking a weightlifting workout.

These and other needs have been met according to the present invention by providing an apparatus and method to track and analyze the key information in a weightlifting workout, including (1) the amount of weight lifted, (2) the number of repetitions, (3) the number of sets performed for each type of weightlifting exercise, and optionally (4) specific settings, e.g., seat height, for exercises performed on adjustable machines. By recording the weight, repetitions, and sets performed for each weightlifting exercise, a weightlifter can track performance over time in order to determine progress and level. These and other needs have also been met according to the present invention by providing an apparatus for tracking a workout comprising: a housing; an input device arranged in said housing; a display device arranged in said housing; a controller coupled to said input device and said display device in said housing; and a memory coupled to said controller, wherein said controller is programmed to query a user to enter weightlifting exercise information through the use of said input device, said information being stored in said memory and being displayed on said display device. These and other needs have also been met by providing an apparatus for tracking a workout comprising: an input device providing input signals for a plurality of data sets, each of said data sets comprising a weight and a number of repetitions; a memory for storing said plurality of data sets; a controller coupled to said memory, said controller receiving said input signals from said input device and providing display signals; a display coupled to said controller, said display receiving said display signals and displaying an output, wherein said controller is programmed to generate at least one display output in accordance with said input signals for tracking a weightlifting workout. These and other needs have also been met by providing a method for tracking a workout comprising the steps of: querying a user to input weightlifting exercise data sets into a data memory by way of an input device, each of said data sets comprising a weight and a number of repetitions; processing said exercise data into an output signal; and displaying said output signal on a display device.

In one preferred embodiment of the present invention, each of the data sets further comprises a number of sets, in this way a user can simplify the recording of the workout, where several workout sets consist of the same weight and the same number of repetitions, by simply inputting the number of sets done at that weight and that number of repetitions, rather than repeatedly entering the same weight and number of repetitions for identical sets. This simplifies the recording procedures by reducing the number of keystrokes.

According to another preferred embodiment of the present invention, a user-definable character string is provided, corresponding to each data set, each exercise, and/or each calendar date. According to this embodiment, a user may input any relevant information into the user-definable character string which relates to the corresponding data set, exercise of calendar date. For example, a user may wish to record the amount of rest taken between successive sets, in which case the user would record this information in the user-definable character string corresponding to the appropriate data set. In addition, a user may wish to record information pertinent to a particular exercise, for example the settings used on adjustable exercise machines, in which case the user would record this information in the user-definable character string corresponding to the appropriate exercise. Furthermore, a user may wish to record other information which may be relevant to their performance on that calendar day, such as how they feel (energetic or tired) information regarding their diet on that day, e.g., consumption of dietary supplements such as protein or energy drinks, etc., in which case the user would record this information in the user-definable character string corresponding to the calendar date.

According to further preferred embodiments of the present invention, each of the data sets may be selectively assigned to one of a plurality of data groups in the data memory, where each of the data groups represents a specific exercise and/or a specific calendar date. In this way, the data sets are stored and may be accessed and displayed in an organized format. For example, if a user wishes to analyze the data regarding a specific exercise over time, according to this preferred embodiment the user can access and display the data in the data group representing the relevant exercise. Furthermore, a user may wish to refer to a complete workout for a particular calendar date. According to this preferred embodiment, the user may access and display the data group representing the specific exercises performed on that specific calendar date.

According to another advantageous embodiment, a user can select pre-set workout routines which are stored in memory. These workout routines may be tailored to varying levels of weightlifting expertise or desired training plans, e.g. a basic workout routine consisting of basic exercises, and intermediate and advanced workout routines including additional or different exercises. It is contemplated to include the workout routines of well-known weightlifters, bodybuilders, and professional athletes. The pre-set workout routines may be further categorized by specific muscles or muscle groups, e.g. upper body workout, lower body workout, biceps workout, quadriceps workout, etc.

In preferred embodiments, the user can customize these pre-set workout routines to accommodate personal desires or training requirements by adding additional exercises to the pre-set routines or by deleting any undesired exercises from the pre-set routines. In another preferred embodiment, the user can create a completely customized workout routine by inputting desired exercises, rather than by changing the pre-set workout routines. In this way, specific exercises of the data groups may be defined by the user, and a user may personalize a workout program to include the specific exercises which he or she performs and prefers.

According to further advantageous embodiments, the present invention may be used to schedule the desired workout routines. The workout routines may be automatically scheduled on specific days of the week, e.g. a customized upper body workout on Mondays and Thursdays. The workout routines may be scheduled at a specified time interval, e.g. a pre-set basic workout every four days, and specific days may be skipped, e.g. weekends or any given day of the week. The workout routines may also be scheduled manually on specific dates in conjunction with a calendar function.

The present invention is preferably made compact, handheld, and portable, such that it can easily be transported from workout station to workout station as a weightlifter goes through a workout. In preferred embodiments, the apparatus of the present invention may be provided with a device for attaching the apparatus to a user's clothing, for example a clip which can be hooked onto a waistline or a pocket, or a belt and holster arrangement.

The overall configuration of the present invention may be similar to that of an electronic calculator or personal address/phone directory. Preferably the workout tracker is made of two pieces joined by a hinge along one side, such that it opens like a book. The keypad is arranged on the lower of the two pieces, and a display screen is arranged on the upper of the two pieces. The screen is preferably an LCD screen, but may be of any known type. Due to its portability, the present invention is constructed of durable materials. For example the housing may be made of an impact-resistant heavy-gauge plastic to withstand rough handling or dropping. Furthermore, the present invention is preferably made water resistant or waterproof to avoid damage in high humidity workout environments or from the sweat of the user.

Any known means for inputting the data may be used. For example, in a simplified embodiment only a numeric keypad need be provided. Since the weight and the number of repetitions are entered as numbers, such a numeric keypad will suffice. However, in preferred embodiments additional keys are provided. Preferably a full alphanumeric keypad is provided to allow user-definable input of letters as well as numbers. Additionally, it is preferred to include "hot" keys, i.e. function keys or macro keys, for more efficiently performing at least the most commonly used functions. Additionally, it is preferred to include navigational keys, i.e. cursor command keys, for more efficient movement through the data sets.

A display is provided which is used to display at least the weight, the repetitions, and the number of sets. Additionally, it is preferred to include the names of the specific exercises on the screen, although in a simplified embodiment these specific names could be omitted or be placed on a non-screen portion adjacent the screen. Furthermore, in preferred embodiments a clock and/or a stopwatch, preferably in digital format, is included in the display. In preferred embodiments, the display is set up in a spreadsheet-type format with the data arranged in rows and columns. In an especially preferred embodiment, the names of the specific exercises are displayed in a column on a left side of the display, with each separate exercise being in a separate row. In this embodiment, the sets may be displayed in successive columns to the right of the column of exercises. Each set column is divided into two sides, one side for the weight, and the other side for the number of repetitions. In this preferred format, each row contains a separate exercise with the weight and the number of repetitions for each set extending to the right of each exercise name.

In the display, any number of exercise names (rows) and sets (columns) may be provided. As an example, thirty separate rows for thirty separate exercises may be provided, with eight "set" columns for recording the weight and number of repetitions for each of eight sets. Although the display may be configured such that all of the rows and columns are displayed on the screen simultaneously, in a preferred embodiment, only a certain number of rows and columns are displayed on the screen at one time, so that the displayed data is of sufficient size for easy readability. In this embodiment, it is necessary that the user be able to scroll the display across the screen to access portions which are not currently being displayed. Therefore, an appropriate means of navigating such as navigational or cursor keys are provided for moving around the display. In this embodiment, it is preferred that the exercise name column remains on the display at all times, with the set columns scrolling to the left and the right. In this way, when a user scrolls to the right to a higher set column which was not previously shown on the screen, the corresponding exercise name will remain on the left side of the screen. Likewise, it is preferred that the column headings for the set numbers remain at the top of the screen, so that when a user scrolls downwardly to a previously undisplayed portion, the user can still easily see which set column is being displayed. In the exercise name column, the names of the exercises scheduled for that specific day are listed in rows, with a blank row between each of the adjacent exercise names. In the set columns, recorded data from the most recent workout corresponding to the exercise name is displayed.

In preferred embodiments, the workout tracker may be provided with an interface for connection with a personal computer, to allow transfer of data between the personal computer and the workout tracker. For example, a centralized database may be maintained on a personal computer, into which several users upload information from the workout tracker into the centralized database. Such a centralized database could then be used for statistical analysis of a group of users, and comparison between a single user and a group. For example, known statistical software could be used to graphically display the progress of a single user or the progress of a single user versus a group of users in a simple x-y chart format. Furthermore, a customized software program could be designed for the personal computer for specific use in conjunction with the present invention, which would conveniently record, display, and analyze the recorded data uploaded from the workout trackers. Such software would be capable of statistically analyzing the data of a single weightlifter, as well as comparing the data of a single weightlifter with that of a group of weightlifters. Such software could also be used to graphically display the data of a single weightlifter and/or a group of weightlifters. Of course the software could also be used to print out the data in any desired format.

The data interface would allow multiple users to use the same workout tracker. For example, a gym or health club could loan out the workout tracker of the present invention to its members to record their workouts. After a user is finished recording a workout, they could then upload the recorded data into a centralized database on a personal computer, and then the workout tracker that they had used would be available to the next member to use for recording a workout. In addition, the data interface would allow standard or personalized routines to be entered on the personal computer and then downloaded to various personal workout trackers.

Although one of the advantages of the present invention is its portability, another contemplated system for recording workouts, for example in a health club or a gym, is to permanently mount a workout tracker by each work station. All of the workout trackers in a health club would then be tied into a central database. In this way, a weightlifter would not have to carry a recording device around the gym to record their workout. Instead, the weightlifter would enter the appropriate information, i.e. the weight, repetitions, and sets, at each work station, and the information would be uploaded to a centralized database for further manipulation and analysis. In this system, the data would have to be identified according to the specific user, for example coded with the user's initials, in order to appropriately record the information for a specific individual. Therefore, in this system each user would have to identify himself or herself at each work station so that the information would be appropriately recorded.

Preferably the recorded workout data is accessible in a per-workout format or in a per-day format. In this way, a user may schedule a particular workout program for a given calendar day, and further may track and analyze his or her progress over a period of time. Furthermore, a user may refer back to previously executed workout regimes conducted on a past calendar date. Preferably, the workout tracker is provided with a calendar display which a user may use to simply access a workout schedule for a future date or the data recorded for a workout already completed on a previous date, or may display an overview of the workouts scheduled for the month.

These and other objects, features and advantages of the present invention will become more readily apparent from the following detailed description when taken in conjunction with the accompanying drawings.

DETAILED DESCRIPTION OF THE DRAWINGS

Figure 1:
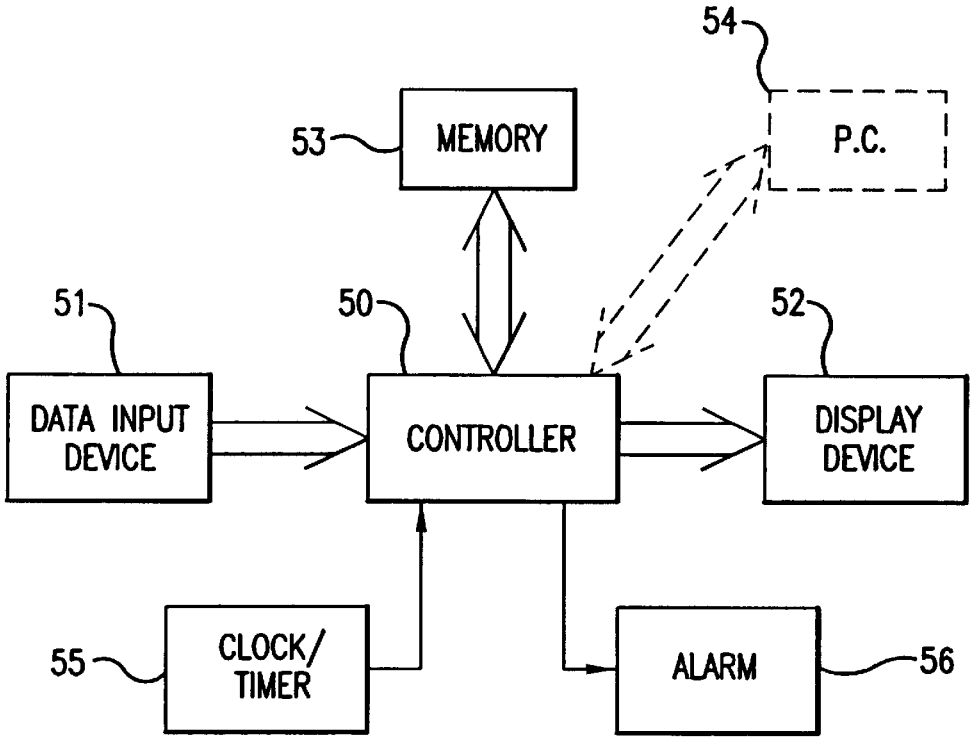
FIG. 1 is a block diagram of a workout tracker according to a preferred embodiment of the present invention.

Referring to FIG. 1, the workout tracker comprises a controller 50 coupled to a data input device 51 for inputting data according to the data input functions hereafter described. The controller 50 is coupled to a display device 52 for displaying data according to the display functions hereinafter described. The controller 50 is coupled to a memory 53 for storing data. The controller 50 includes logic for controlling the input of data from the data input device 51, logic for controlling the display of data on the display device 52, logic for storing and retrieving data from the memory 53, and logic for interfacing with a personal computer 54. The controller 50 may be a general purpose processor programmed with instructions that cause the processor to perform the described steps, specific hardware components that contain hard-wired logic for performing the described steps, or any combination of programmed general purpose computer components and custom hardware components. A clock/timer 55 and an alarm 56 are coupled to the controller 50.

Figure 2:
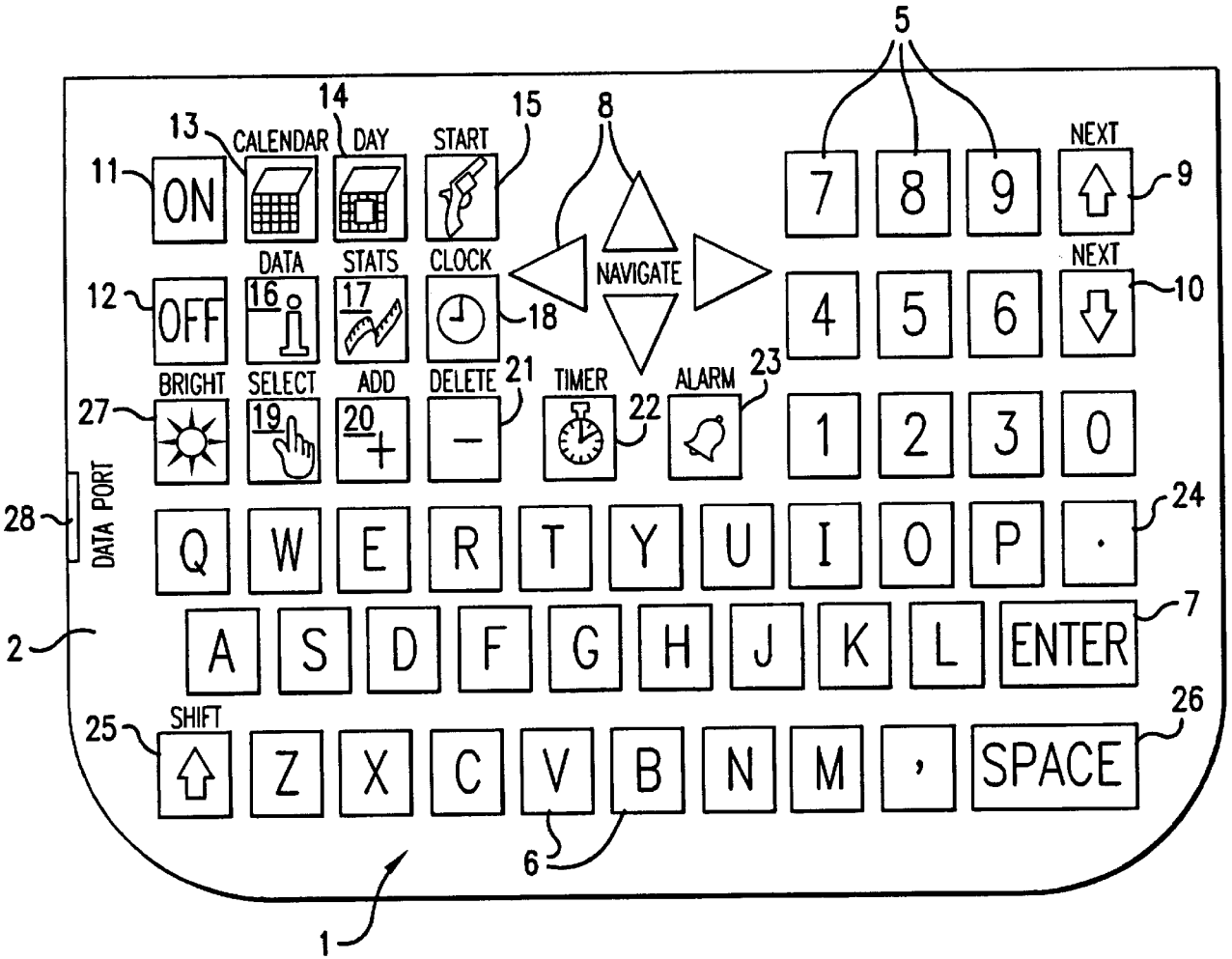
FIG. 2 shows a keypad for the workout tracker.
Figure 3:
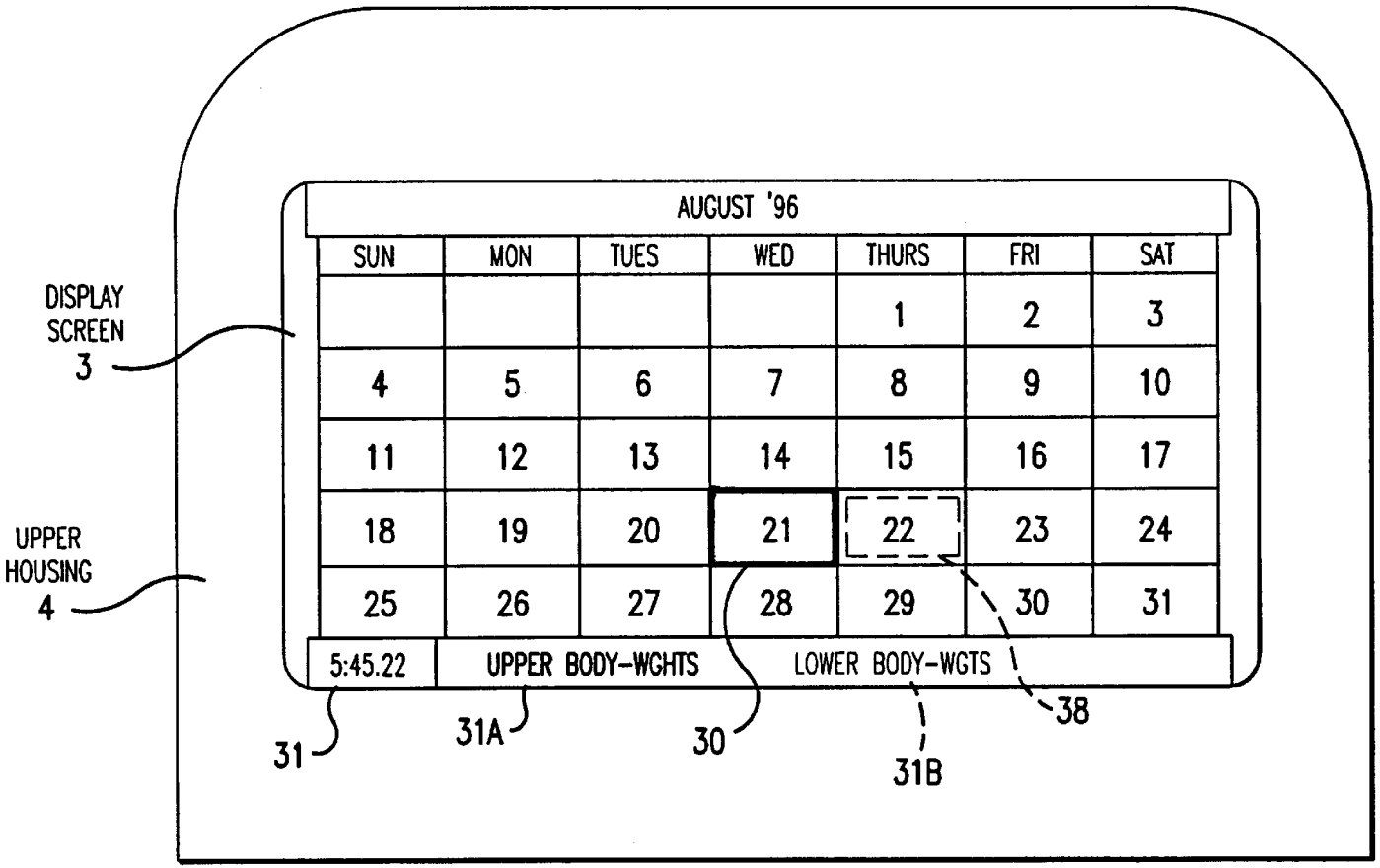
FIG. 3 shows a display screen for the workout tracker in a calendar mode.

Referring to FIGS. 2 and 3, the workout tracker includes a keypad 1 arranged in a lower housing 2, and a display screen 3 arranged in an upper housing 4. The keypad 1 comprises numeric (0–9) keys 5; alpha (A–Z) keys 6; enter key 7; navigate keys 8; "NEXT" up-arrow key 9; "NEXT" down-arrow key 10; on-key 11; off-key 12; calendar function key 13; day function key 14; start function key 15; data function key 16; statistics function key 17; clock function key 18; select function key 19; add function key 20; delete function key 21; timer function key 22; alarm function key 23; decimal point/period key 24; shift key 25; space key 26, and "bright" function key 27. A data port 28 is provided in the lower housing 2 for interfacing with other workout trackers or a personal computer. The keypad shown in FIG. 2 is only an example of a preferred embodiment, and may have additional or fewer keys, and the keys may be arranged in any configuration.

The workout tracker is powered-up by pressing the on-key 11. Once the workout tracker is powered-up, a user proceeds by pressing the appropriate keys corresponding to the functions he or she wishes to execute. Pressing the calendar function key 13 brings up the calendar mode on the display screen 3. As shown in FIG. 3, the current month is displayed and the current day is highlighted by a cursor 30.

The cursor 30 is moved from day to day by using the navigate keys 8. A lower portion 31 of the display screen is reserved for displaying other information, in this case the current time and the type of workout 31A scheduled for the day. If the cursor is moved from position 30 to position 38, the workout 31B for that date is displayed in the lower portion 31. The calendar display is moved from month to month by pressing the "NEXT" up-arrow key and the "NEXT" down-arrow key. The cursor is moved from day to day within the calendar display by pressing the navigate keys 8.

Figure 4:
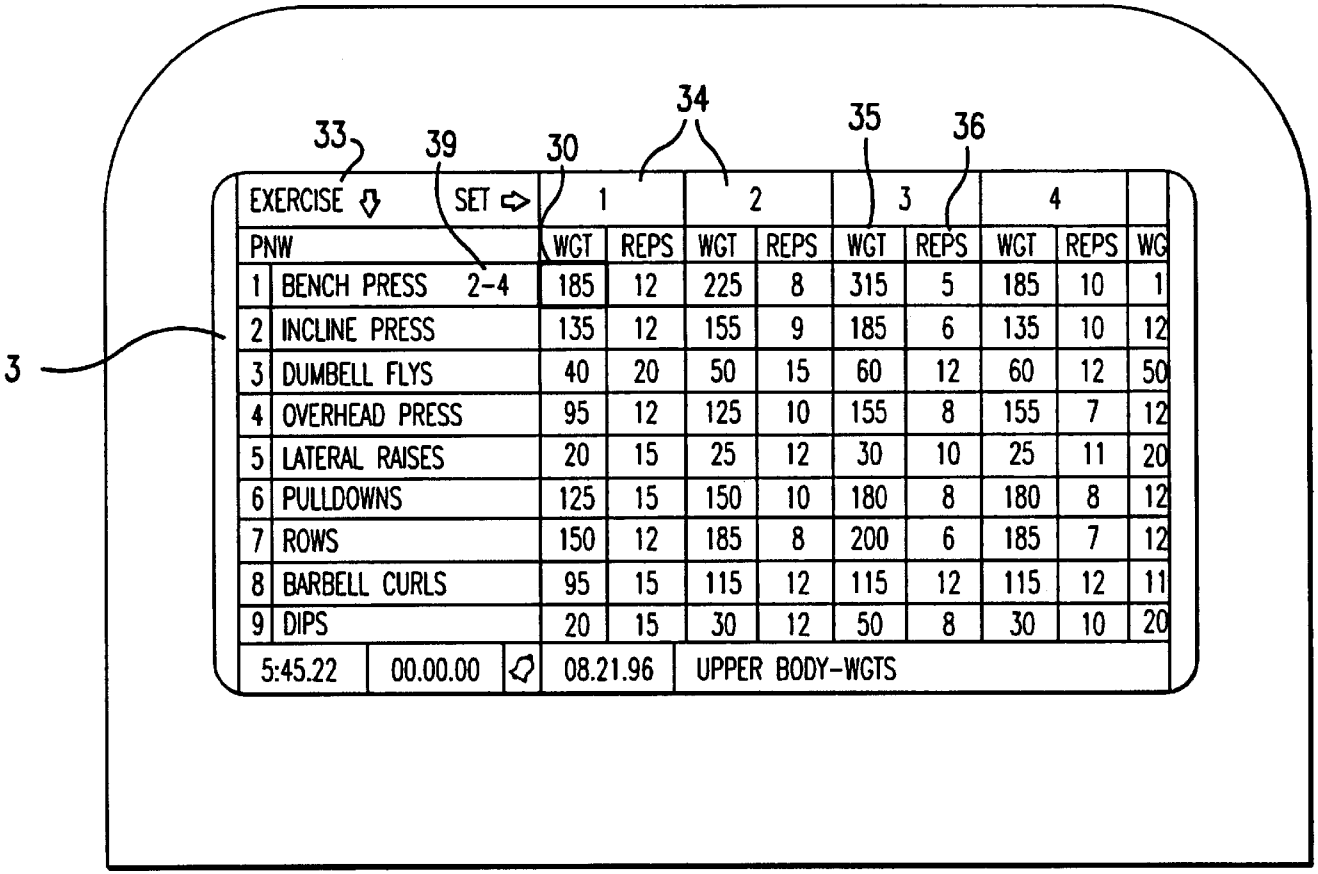
FIG. 4 shows the display screen in a data display mode.

Once the desired day has been highlighted with the cursor 30, the "DAY" function key 14 is pressed to display the data display mode for that specific day. If workout data has already been recorded for the selected day, that data will be displayed, as shown in FIG. 4. If no workout data has been recorded for the selected day, then the names of the exercises for a workout scheduled for that day would be shown without any entries in the set columns. Alternatively, when no workout data has been recorded for the selected day, the display mode can display the data recorded the last time the selected routine was performed. For example, if the "UPPER BODY-WGTS." routine is selected as shown in FIG. 4, the display mode may show the data recorded the last time the "UPPER BODY-WGTS." routine was performed to give the user an overview of the previous performance.

In the data display mode, the exercise names are listed in separate rows along the left-hand side of the display screen in an exercise name column 33. The exercise names may also include appropriate settings 39 for adjustable exercise machines, which may be entered by the user. In the example shown the settings 39 indicate that for the exercise "BENCH PRESS" the seat was set at setting "2" and the bar was set at setting "4". Alternatively, the settings 39 may be contained in a separate field.

Extending to the right of the exercise name column 33 are set columns 34 which are numbered consecutively and each of which is subdivided into a weight column 35 and a repetitions column 36. Each exercise name has a weight data field and a repetitions data field corresponding to each set. Although only nine exercises and four set columns are shown on the display screen 3 in FIG. 4, the workout display may contain any number of exercises and set columns. To access portions of the display which are not currently shown on the display screen, the navigate keys 8 are used to move the cursor 30 to a desired position. The exercise name column 33 remains fixed when the cursor 30 is moved to the left and to the right, so that a user can always identify which exercise corresponds to the data being displayed. As shown in FIG. 4, the lower portion 31 of the screen displays the current time, the timer/stopwatch function, the current date, and the type of workout in the data mode. This lower portion 31 remains on the display screen in the workout display, i.e. this lower portion does not scroll off of the screen when the cursor 30 is moved upward in the workout display.

Figure 5:
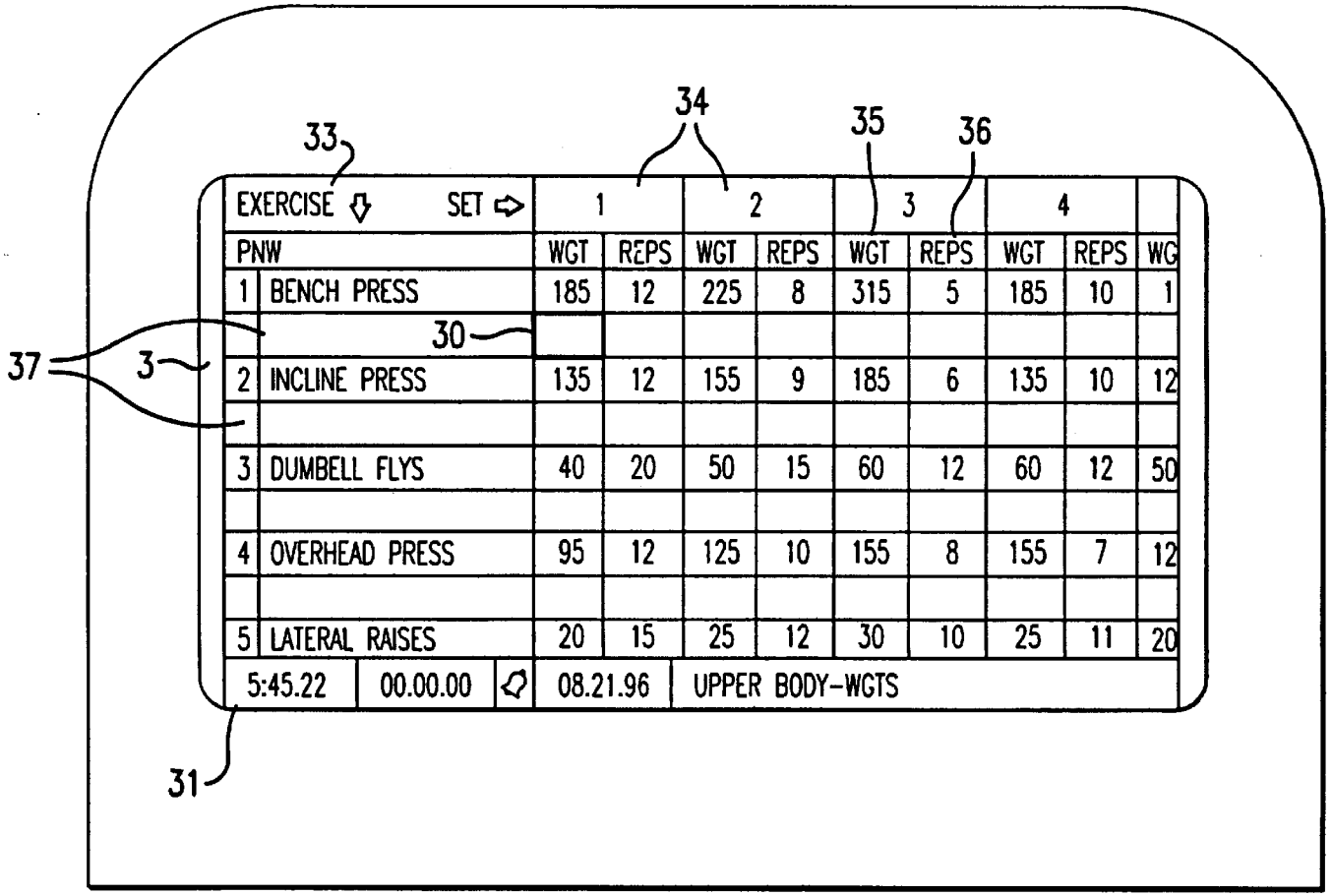
FIG. 5 shows the display screen in a data entry mode.

In order to record workout data, the start function key is pressed which brings up the data entry mode shown in FIG. 5 on the display screen 3. In the exercise name column 33, the names of the exercises scheduled for that specific day are listed in rows, with a blank row 37 between each of the adjacent exercise names. In the set columns 34, recorded data from the most recent workout corresponding to the exercise name is displayed. The cursor 30 is automatically positioned in the first entry field, in this case the weight column 35 of the first set column 34. After completing one set of an exercise, a user inputs the amount of weight lifted using the numeric keys 5, and then presses the enter key. The cursor 30 then automatically moves to the repetitions column 36 where the user enters the number of repetitions by using the numeric keys 5 and again presses the enter key. The cursor 30 continues to move to the right through the successive weight columns 35 and corresponding repetition columns 36 as the user enters the workout data. When a user has finished one type of exercise, and wishes to enter information or a successive exercise, the user may either use the navigate keys to move the cursor to the appropriate entry field, or in preferred embodiments may simply press the NEXT down-arrow key 10 to move the cursor to the first entry field for the succeeding exercise name.

As shown in FIG. 5, the lower portion 31 of the display screen displays the current time, the timer/stopwatch function, the current date, and the type of workout in the data entry mode. A weightlifter who wishes to keep track of the rest period between exercise sets presses the timer key 22 which automatically starts the stopwatch shown in the lower portion 31 of the display screen. Furthermore, a user who wishes to be notified of a specific time interval between sets may further use the alarm function key 23 to set off an alarm at a predetermined time interval. In preferred embodiments, each set column 34 may be subdivided into further columns, for example, a sub-column for recording the time interval between sets. In such an embodiment, the workout tracker may be programmed to automatically record the time interval based on the amount of time between data entries without any additional key input from a user.

In further preferred embodiments, a user-definable character string may be associated with each of the set columns, each of the exercise names, or each calendar date for recording any desired information by a user, for example information regarding how the user felt during the workout (energetic or tired), information regarding their diet on that day, e.g., consumption of dietary supplements such as protein or energy drinks, the amount of rest taken between sets, etc.

When first using the workout tracker, basic setup functions may be performed. Pressing the select key 19 brings up the program set-up mode shown in FIG. 6 on the display screen 3. A user may choose among three pre-set routines to match personal fitness objectives (basic, intermediate, and advanced) by moving the cursor 30 with the navigate keys 8 and then pressing the enter key 7.

Figure 6:
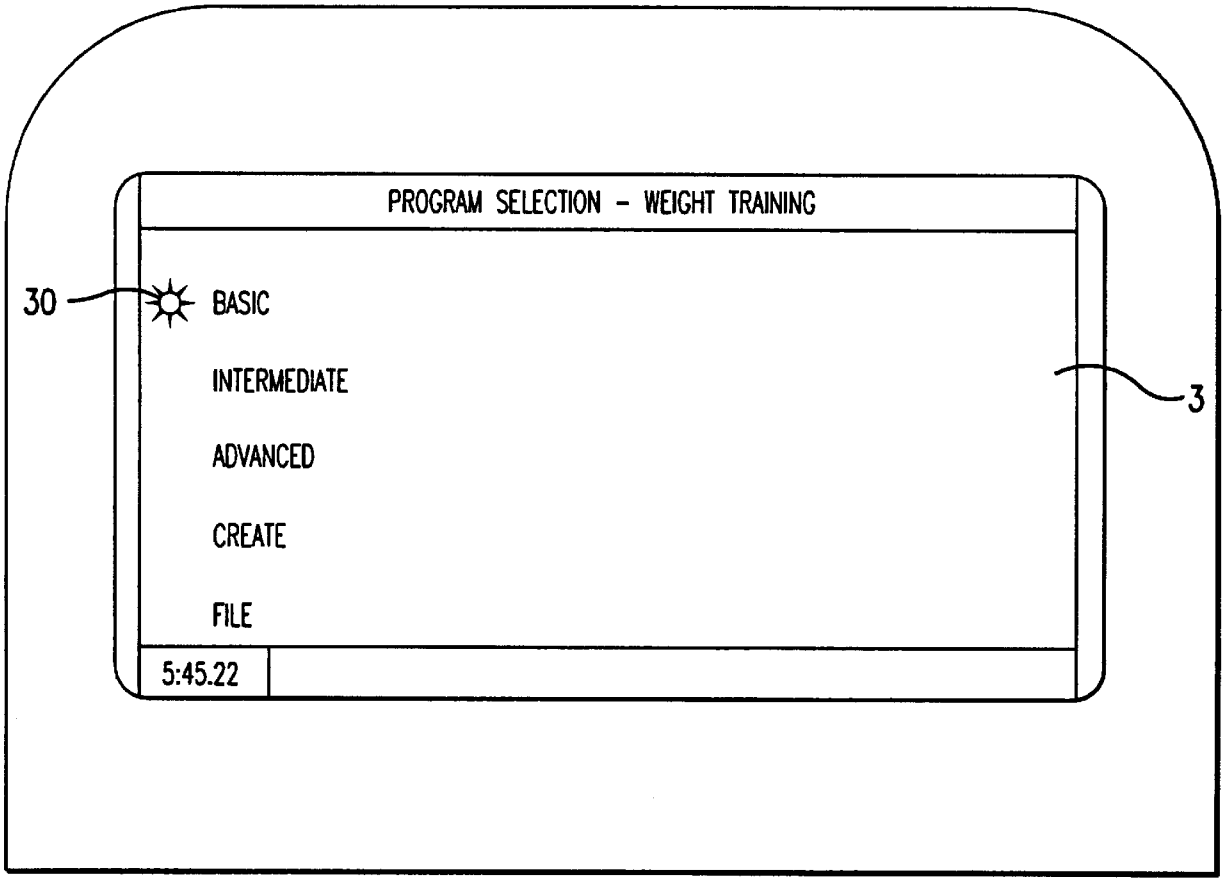
FIG. 6 shows the display screen in a program set-up mode.
Figure 7:
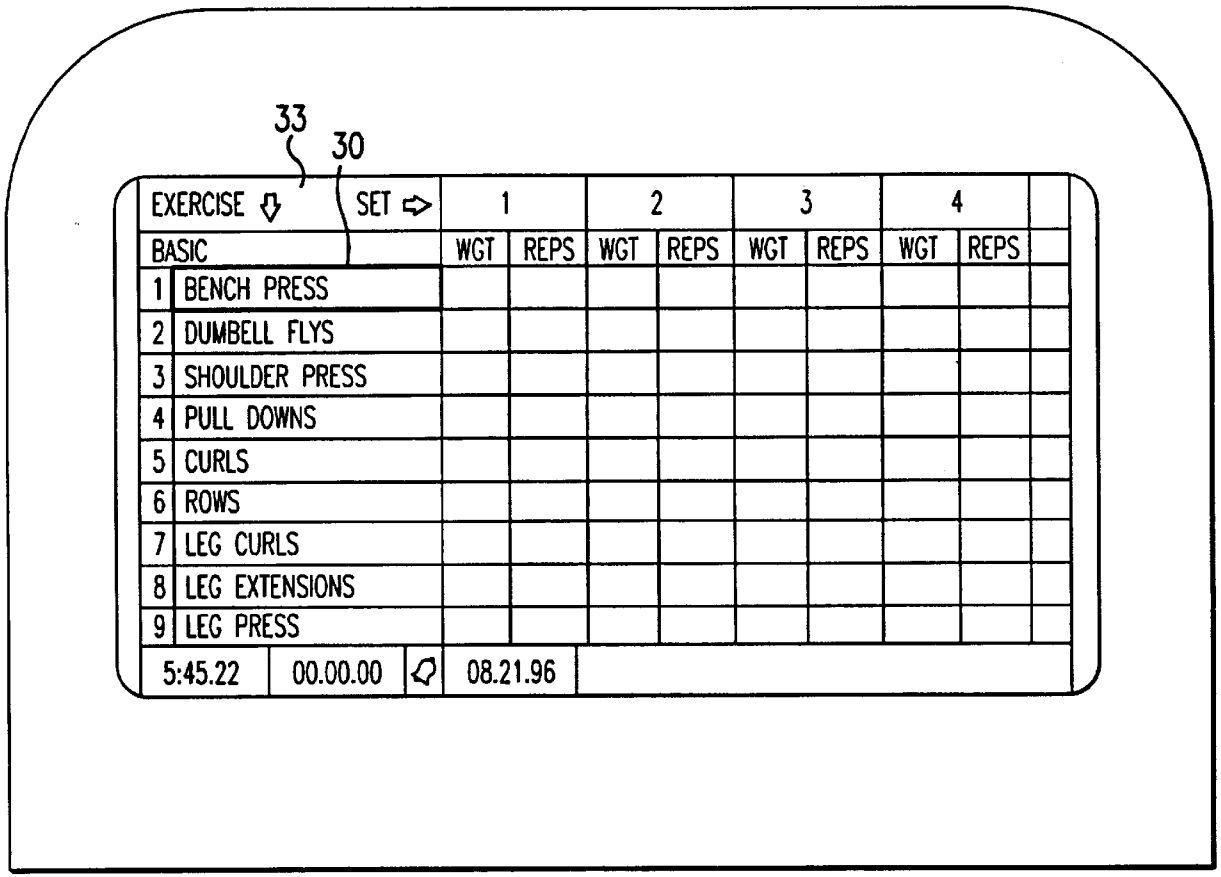
FIG. 7 shows the display screen with a pre-set exercise routine.

FIG. 7 shows an example of a basic pre-set exercise routine. This screen is reached by pressing enter when the cursor 30 is beside the word "BASIC" as shown in FIG. 6. A user may accept the preset routine as it is, or may customize the routine by adding or deleting exercises. In order to add an exercise, the user positions the cursor in the exercise name column 33 at the position where the exercise is to be added, and then presses the add function key 20. A new row will be created, i.e. the succeeding exercise names will each scroll down one row, and the user can then enter the desired additional exercise in the new row using the alpha keys 6. In order to delete an exercise from the routine display, the user simply positions the cursor on the exercise name to be deleted, and then presses the delete key 21. The exercise name will be deleted, and successive exercise names will automatically scroll up to fill in the empty space, and the routine will be appropriately renumbered.

Figure 8:
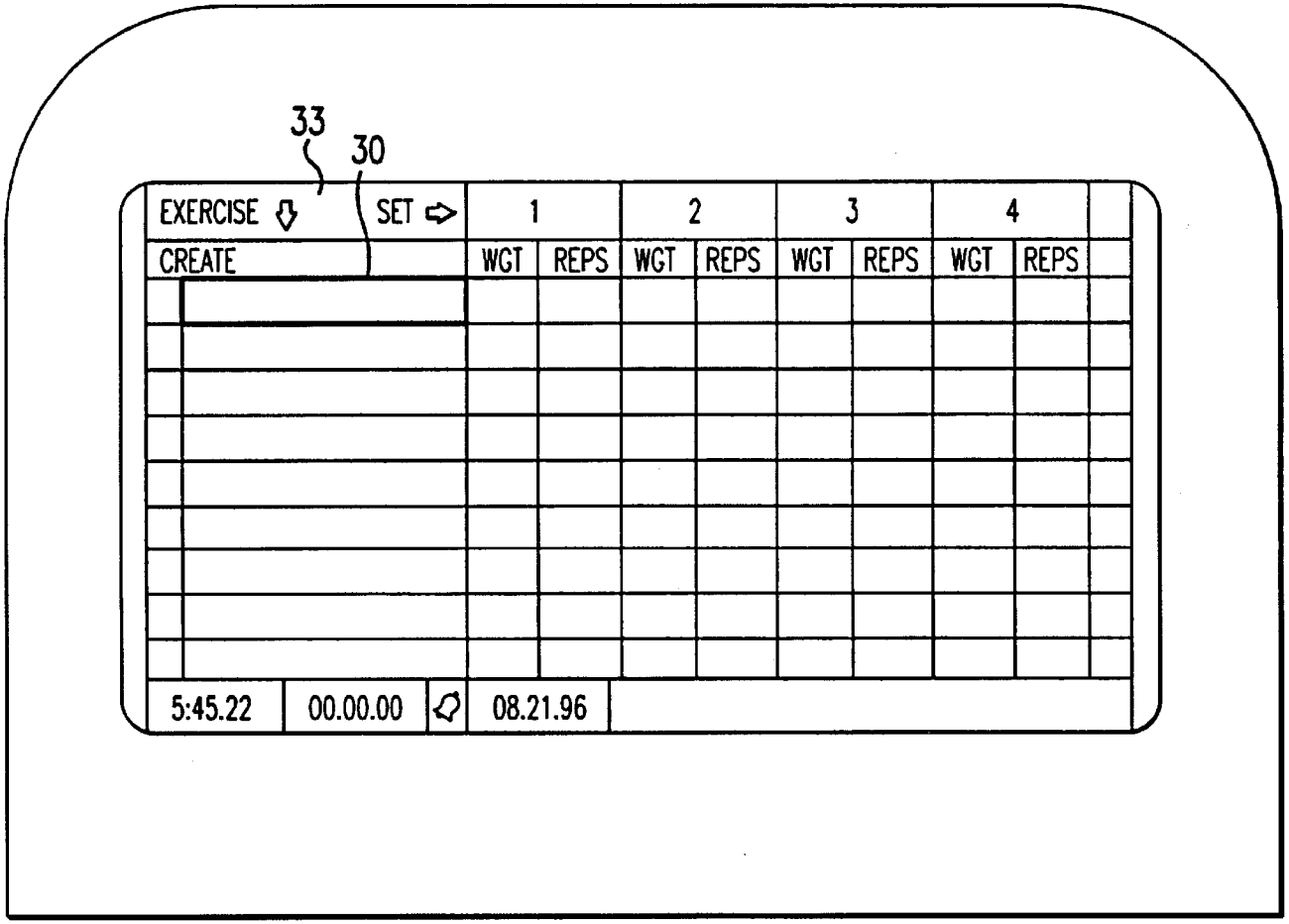
FIG. 8 shows a display in a user-definable program mode.

Rather than customizing a pre-set exercise routine by adding and deleting exercises, a weightlifter may create a completely personalized routine by selecting "CREATE" in the program set-up mode. This will bring up a user-definable program mode as shown in FIG. 8, in which a user may then enter desired exercise names and optionally adjustable machine settings in the exercise name column 33 by using the alpha keys 6 and/or the numeric keys 5. The cursor 30 is automatically positioned in the first entry field and moved downwardly after each exercise name is entered. This display may also be changed by using the add key 20 and the delete key 21 as described above in reference to FIG. 7.

Figure 9:
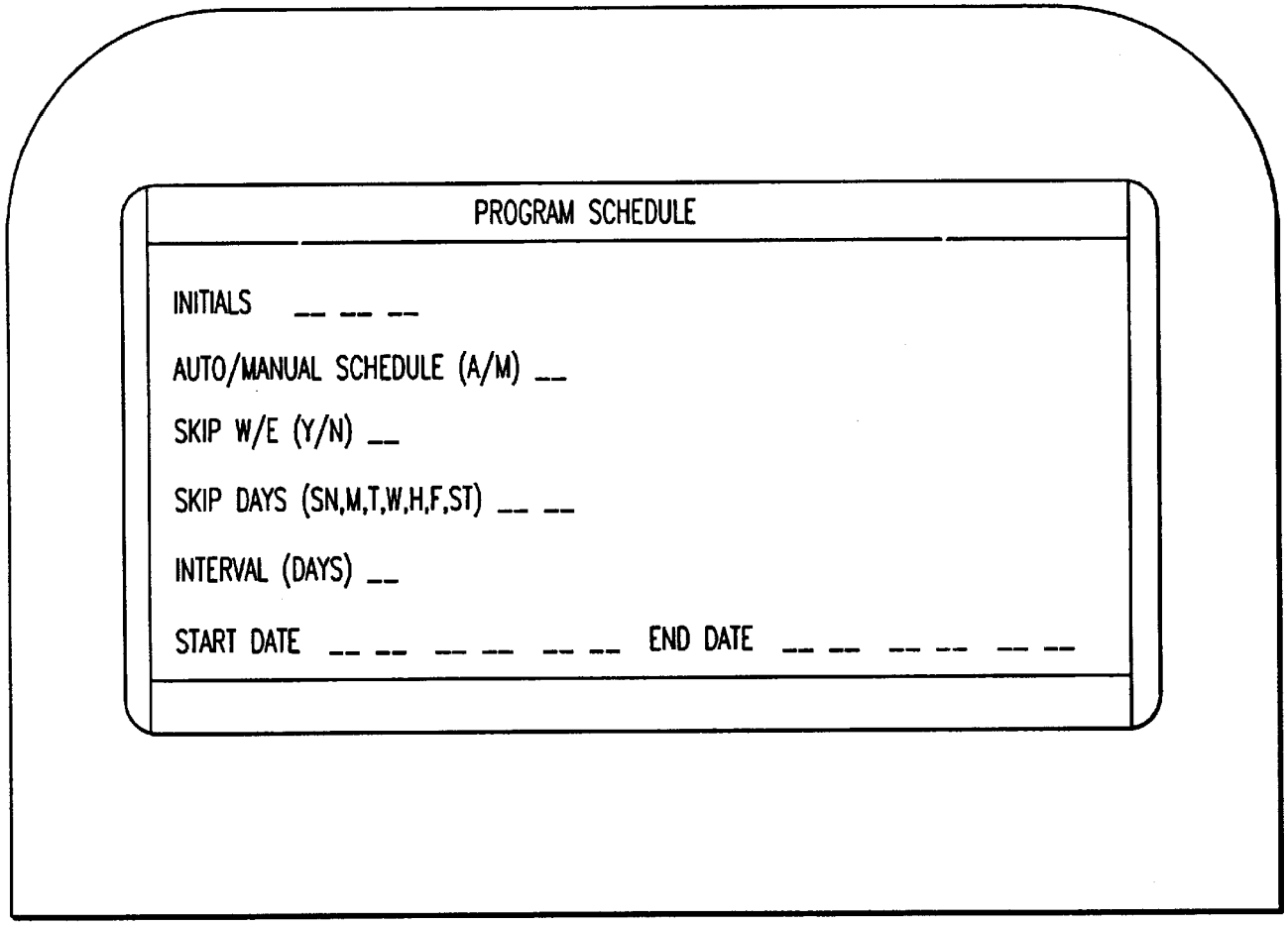
FIG. 9 shows a display in a scheduling mode.

Once a user has chosen an exercise routine, either by selecting a pre-set routine or by creating a customized routine, the user moves to the scheduling mode shown in FIG. 9 by again pressing the select key 19. The user then enters the appropriate information for scheduling the selected workout, for example scheduling on specific days of the week, or with a given time interval between workouts for an appropriate range of dates.

Rather than following a predetermined workout schedule, a user may prefer to enter the exercise names as he or she progresses through a workout, particularly if a specific routine is not being followed. This is accomplished by going directly from the create display shown in FIG. 8 to the record display shown in FIG. 5 by pressing the start key 15. According to this embodiment, a weightlifter can simply enter the successive exercise names as he or she proceeds throughout a workout, along with the weight and repetitions for each set, as well as machine settings if appropriate.

Figure 10:
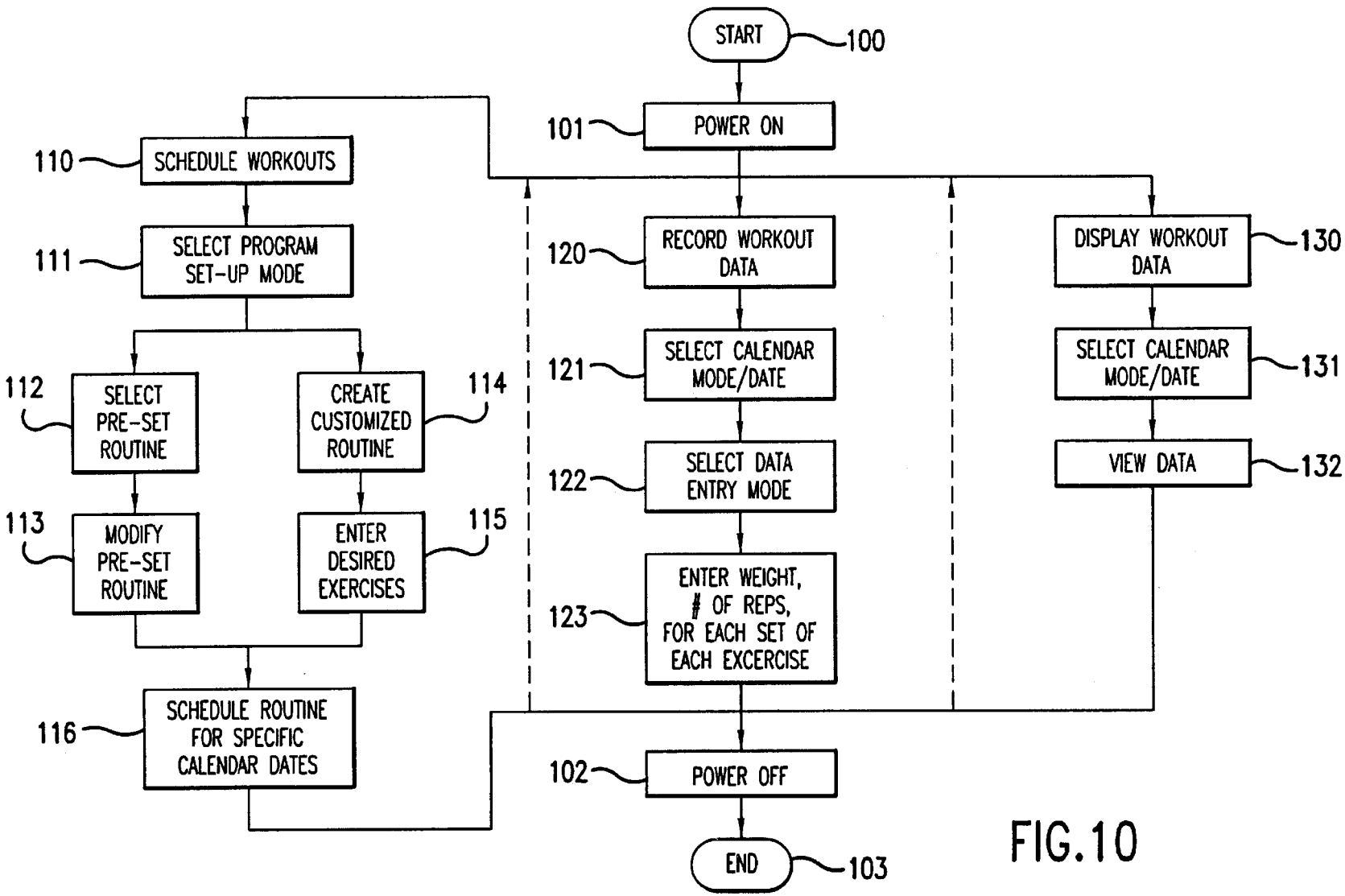
FIG. 10 shows a flow chart of a method according to a preferred embodiment of the present invention.

FIG. 10 is a flow chart which shows steps of the above-described functions which can be carried out by the workout tracker according to the present invention. A user starts using the workout tracker 100 by turning the power on 101. The user may then execute the above-described functions, including scheduling weightlifting workouts 110, recording weightlifting workout data 120, and displaying weightlifting workout data 130. In order to schedule weightlifting workouts 110, the user performs the step of selecting the program set-up mode 111. Then the user may either perform the step of selecting a pre-set weightlifting routine 112, or may select to create a customized weightlifting routine 114. If the user selects a pre-set weightlifting routine 112, the user may optionally perform the step of modifying the pre-set routine 113. If the user selects to create a customized weightlifting routine 114, the user then performs the step of entering the desired exercise names 115 and optionally adjustable machine settings. Once a desired weightlifting routine has been established, the user performs the step of scheduling the weightlifting routine for specific calendar dates 116. After the weightlifting routine has been scheduled, the user may execute any of the other functions, schedule another weightlifting workout 110, or perform the step of shutting the power off 102 to end use of the workout tracker 103.

In order to record weightlifting workout data 120, the user performs the step of selecting the calendar mode and date 121. Then the user performs the step of selecting the data entry mode 122. Subsequently, the user performs the step of inputting the weight and the number of repetitions for each set of each exercise 123. After the weightlifting workout data has been recorded, the user may execute any of the other functions, record further weightlifting workout data 120, or perform the step of shutting the power off 102 to end use of the workout tracker 103.

In order to display weightlifting workout data 130, the user performs the step of selecting the calendar mode and date 131. The user then views the workout data 132 for the selected calendar date. After the weightlifting data has been displayed, the user may execute further functions, display further weightlifting data 130, or perform the step of shutting the power off 102 to end use of the workout tracker 103.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A hand-held, portable apparatus for tracking a weightlifting workout comprising:

a housing;

an input device arranged in said housing;

a display device arranged in said housing;

a controller arranged in said housing and coupled to said input device and said display device; and a memory coupled to said controller, wherein said controller is programmed to query a user to enter weightlifting exercise information through the use of said input device, said information including a weight and a number of repetitions corresponding to a specific weightlifting exercise, said information being stored in said memory and being selectively retrievable from said memory by said user through the use of said input device to be displayed on said display device.

2. An apparatus for tracking a weightlifting workout according to claim 1, wherein said information further includes a number of sets for said specific weightlifting exercise.

3. An apparatus for tracking a weightlifting workout according to claim 1, wherein said controller is programmed to query a user to enter a weightlifting workout routine through the use of said input device, said weightlifting workout routine being stored in said memory and being retrievable from said memory by said user through the use of said input device to be displayed on said display device.

4. An apparatus for tracking a weightlifting workout according to claim 3, wherein said controller is programmed to query a user to schedule said weightlifting workout routine for a specific calendar date through the use of said input device.

5. An apparatus for tracking a weightlifting workout according to claim 1, wherein a plurality of pre-set weightlifting workout routines are stored in said memory, and wherein said controller is programmed to query a user to select one of said pre-set weightlifting workout routines.

6. An apparatus for tracking a weightlifting workout according to claim 5, wherein said controller is programmed to query a user to schedule said one of said pre-set weightlifting workout routines for a specific calendar date.

7. A hand-held, portable apparatus for tracking a weightlifting workout comprising:

an input device operable by a user to generate input signals for a plurality of data sets, each of said data sets comprising a weight and a number of repetitions, each of said data sets corresponding to a specific weightlifting exercise;

a memory for storing said plurality of data sets;

a controller coupled to said memory, said controller receiving said input signals from said input device and providing display signals;

a display device coupled to said controller, said display device receiving said display signals and displaying an output, wherein said controller is programmed to retrieve selected ones of said data sets from said memory and display said selected ones of said data sets on said display device in response to a request made by a user via said input device.

8. An apparatus for tracking a weightlifting workout according to claim 7, wherein said controller is programmed to selectively assign each of said data sets to one of a plurality of data groups, each of said data groups representing a specific exercise, said data sets being retrievable and displayable according to said data groups.

9. An apparatus for tracking a weightlifting workout according to claim 7, wherein said controller is programmed to selectively assign each of said data sets to one of a plurality of data groups, each of said data groups representing a specific calendar date, said data sets being retrievable and displayable according to said data groups.

10. An apparatus for tracking a weightlifting workout according to claim 7, wherein said controller is programmed to query a user to enter a weightlifting workout routine through the use of said input device, said weightlifting workout routine being stored in said memory and being displayed on said display device.

11. An apparatus for tracking a weightlifting workout according to claim 10, wherein said controller is programmed to query a user to schedule said weightlifting workout routine for a specific calendar date through the use of said input device.

12. An apparatus for tracking a weightlifting workout according to claim 7, wherein a plurality of pre-set weightlifting workout routines are stored in said memory, and wherein said controller is programmed to query a user to select one of said pre-set weightlifting workout routines.

13. An apparatus for tracking a weightlifting workout according to claim 12, wherein said controller is programmed to query a user to schedule said weightlifting workout routine for a specific calendar date.

14. An apparatus for tracking a weightlifting workout according to claim 7, wherein said apparatus comprises a self-contained hand-held unit.

15. An apparatus for tracking a weightlifting workout according to claim 7, wherein said specific exercises of said data groups are user-definable.

16. A method for tracking a weightlifting workout comprising the steps of:

providing a hand-held, portable housing containing an input device, a data memory, and a display device;

querying a user to input weightlifting exercise data sets by way of said input device, each of said data sets comprising a weight and a number of repetitions corresponding to a specific weightlifting exercise;

storing said data sets in said data memory;

accepting a request from said user via said input device to display selected ones of said data sets;

retrieving said selected ones of said data sets from said data memory;

and displaying said selected ones of said data sets on said display device.

17. A method for tracking a weightlifting workout according to claim 16, wherein each of said data sets further comprises a number of sets.

18. A method for tracking a weightlifting workout according to claim 16, wherein each of said data sets further comprises a user-definable character string.

19. A method for tracking a weightlifting workout according to claim 16, further comprising the step of selectively assigning each of said data sets to one of a plurality of data groups in said data memory, each of said data groups representing a specific exercise.

20. A method for tracking a weightlifting workout according to claim 16, further comprising the step of selectively assigning each of said data sets to one of a plurality of data groups in said data memory, each of said data groups representing a specific calendar date.

21. A method for tracking a weightlifting workout according to claim 19, further comprising the step of displaying said data sets according to said data groups.

22. A method for tracking a weightlifting workout according to claim 20, further comprising the step of displaying said data sets according to said data groups.

23. A method for tracking a weightlifting workout according to claim 22, wherein said specific exercises of said data groups are user-definable.

24. A method for tracking a weightlifting workout according to claim 16, further comprising the step of querying said user to enter a weightlifting workout routine by way of said input device, said weightlifting workout routine being stored in said memory and being displayed on said display device.

25. A method for tracking a weightlifting workout according to claim 24, further comprising the step of querying said user to schedule said weightlifting workout routine for a specific calendar date.

26. A method for tracking a weightlifting workout according to claim 16, wherein a plurality of pre-set weightlifting workout routines are stored in said memory, and further comprising the step of querying said user to select one of said pre-set weightlifting workout routines.

27. A method for tracking a weightlifting workout according to claim 26, further comprising the step of querying said user to schedule said one of said pre-set weightlifting workout routines for a specific calendar date.

* * * * *